US009585479B2

(12) United States Patent
Keilhauer et al.

(10) Patent No.: US 9,585,479 B2
(45) Date of Patent: Mar. 7, 2017

(54) SEAT PAN-BASED SPRING TILT MECHANISM

(71) Applicant: Keilhauer Ltd., Toronto (CA)

(72) Inventors: Steve Keilhauer, Toronto (CA); Martin Bergmann, Vienna (AT); Gernot Bohmann, Vienna (AT); Harald Grundl, Vienna (AT)

(73) Assignee: KEILHAUER LTD., Toronto (CA)

( * ) Notice: Subject to any disclaimer, the term of this patent is extended or adjusted under 35 U.S.C. 154(b) by 0 days.

(21) Appl. No.: 14/722,739

(22) Filed: May 27, 2015

(65) Prior Publication Data

US 2015/0342353 A1 Dec. 3, 2015

(30) Foreign Application Priority Data

May 27, 2014 (CA) ..... 2852691

(51) Int. Cl.
*A47C 1/032* (2006.01)
*A47C 1/024* (2006.01)

(52) U.S. Cl.
CPC ..... *A47C 1/03272* (2013.01); *A47C 1/024* (2013.01); *A47C 1/03255* (2013.01)

(58) Field of Classification Search
CPC ..... A47C 1/024; A47C 1/03272
USPC ..... 297/316, 327
See application file for complete search history.

(56) References Cited

U.S. PATENT DOCUMENTS 4,796,952 A * 1/1989 Piretti ..... A47C 1/03272 297/300.5
5,601,336 A * 2/1997 Troyas-Bermejo A47C 1/03255 297/300.2
6,283,548 B1 * 9/2001 Husemann ..... A47C 1/03255 297/300.1
2002/0171278 A1 * 11/2002 Stulik ..... A47C 1/03255 297/302.4
2003/0001417 A1 * 1/2003 Moreschi ..... A47C 1/03238 297/300.5
2004/0140703 A1 * 7/2004 Bock ..... A47C 1/03255 297/300.5
2008/0136239 A1 * 6/2008 Bock ..... A47C 1/03255 297/340
2012/0205952 A1 * 8/2012 Takeuchi ..... A47C 1/03 297/300.1
2013/0038105 A1 * 2/2013 Sander ..... A47C 1/03255 297/303.1
2013/0057037 A1 * 3/2013 Horiki ..... A47C 1/03255 297/301.1

(Continued)

*Primary Examiner* — Timothy J Brindley
(74) *Attorney, Agent, or Firm* — Patterson & Sheridan, L.L.P.

(57) ABSTRACT

An "invisible" syncro tilt mechanism is provided for chairs. The chair has a seat with a back portion and a seat pan portion and the seat pan portion is connected to the back portion and to a pivotable support structure, and thereby to a base. The mechanism has a generally closed track defined in the seat pan portion. A plunger is attached to a front portion of the pivotable support structure. The plunger is slidably disposed in the track. A spring is disposed in the track which is connected at opposing ends to the plunger and to a front end of the track. The mechanism does not extend or protrude outside of the seat pan. The mechanism provides synchronous movement of the plunger in the track.

8 Claims, 5 Drawing Sheets

(56) References Cited

U.S. PATENT DOCUMENTS

| | | | | |
|---|---|---|---|---|
| 2013/0313883 | A1* | 11/2013 | Machael | A47C 1/03294<br>297/452.18 |
| 2014/0159452 | A1* | 6/2014 | Potrykus | A47C 1/03272<br>297/300.2 |
| 2014/0300164 | A1* | 10/2014 | Oda | A47C 1/03266<br>297/354.1 |
| 2015/0123441 | A1* | 5/2015 | Duke | A47C 1/03255<br>297/300.4 |
| 2015/0164225 | A1* | 6/2015 | Bohmann | A47C 1/03255<br>297/313 |
| 2015/0282620 | A1* | 10/2015 | Bock | A47C 1/03211<br>297/342 |
| 2015/0289660 | A1* | 10/2015 | Su | A47C 1/03272<br>297/298 |

* cited by examiner

SEAT PAN-BASED SPRING TILT MECHANISM

CROSS-REFERENCE TO RELATED APPLICATIONS

This application claims benefit of Canadian patent application number 2,852,691, filed May 27, 2014, which is herein incorporated by reference.

FIELD OF THE INVENTION

The invention relates to chairs, and more particularly, to mechanisms for enabling chairs to tilt.

BACKGROUND OF THE INVENTION

Description of the Related Art

In the field of office or task chairs, there are various mechanisms for allowing a user to tilt rearwardly in the seat. Some of these mechanisms are:

- Dynamic: A type of mechanism which allows a user to recline. As the back reclines, the seat moves rearwards and down. Some allow the user to lock a particular angle of the back rest.
- Knee-Tilt: A type of mechanism which allows a user to tilt/rock from below the knee. The user's knees go up slightly as the back rest and rear of the seat recline.
- Multifunction Mechanism: A type of mechanism which allows a user to vary the back and seat angles independently of each other and independently of the degree of tilt. The user can therefore select a large range of independent adjustments and body angles in which to sit. Typically, such models have many controls and locks which the user customizes to suit his/her preferences.

One mechanism that has become more common is a syncro-tilt mechanism. In a syncro-tilt mechanism, the seat and back are linked and simultaneously tilt as the user leans back. Typically, the back tilts several degrees for every one degree of seat pan tilt (e.g. 2:1 or 3:1). Chairs with a syncro-tilt mechanism do not typically need to be "customized" in advance, and therefore are popular in office settings where they can be swapped among users. The chair follows the natural movements of the user, rather than needing advance programming to set tilt preferences.

However, syncro-tilt mechanisms typically involve large resistive components (ie: springs) to provide recline tension for the syncro-tilt function. These components are incorporated into the upper base of the chair directly under the seat and take up a lot of space under the chair. Such components are usually painted or powder-coated black to minimize their appearance but there is no escaping the fact that they visually detract from an otherwise sleek office chair design. The bulky mechanisms typically also have adjustment knobs, levers or other controls that protrude. Besides contributing to the visual clutter, these protrusions can also catch on the user's pants or skirts.

It would be desirable to provide the comfort and convenience of a syncro-tilt mechanism with less clutter and visual and physical bulkiness.

SUMMARY OF THE INVENTION

According to a first aspect of the present invention, an improved seat tilt mechanism is provided for a chair having a back portion and a seat pan portion, of the type where the seat portion is connected to the back portion and to a pivotable support structure, and thereby to a base. The mechanism, located in the seat pan portion, has a generally closed track defined in the seat pan portion. A front end of the track has a first attachment point. A plunger is attached to a front portion of the pivotable support structure. The plunger is disposed in the track and slideable therein. A front end of the plunger has a second attachment point. A spring is disposed in the track connected at opposing ends to the first attachment point and to the second attachment point. As the back portion is tilted backward such that the back of the seat pan portion is pulled backward and downward with the back portion against the pivotable support structure. The spring of the mechanism is compressed between the first attachment point and the second attachment point. When tilting force is removed, the spring returns the seat pan portion and thereby the back portion into neutral orientation. The mechanism does not extend or protrude outside of the seat pan.

In at least one embodiment, the track may be coated for anti-friction or may comprise an anti-friction sleeve. The plunger may itself have an anti-friction sleeve.

Preferably, the mechanism further comprises a barrier or wedge disposed in the track behind the plunger, the barrier or wedge acting as a backstop and pre-tensioner.

In at least one embodiment, the spring is a coil spring.

Preferably, the plunger is shaped to allow pivotal rotation and torsional rotation. Preferably, the plunger is shaped to allow compression of a horizontal compression spring.

DETAILED DESCRIPTION

Figure 1:
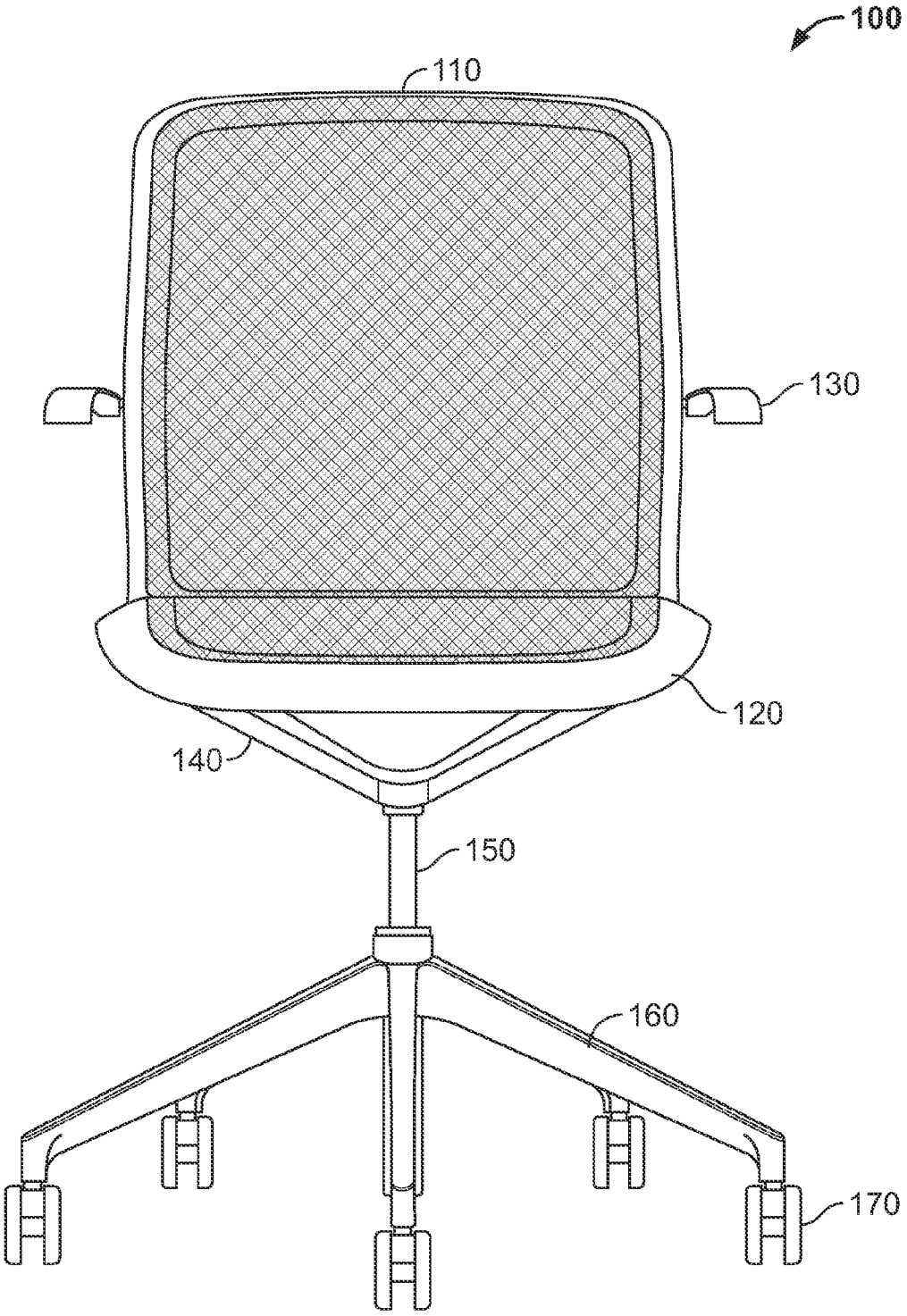
FIG. 1 is a front view of a chair according to an embodiment of the present invention.
Figure 2:
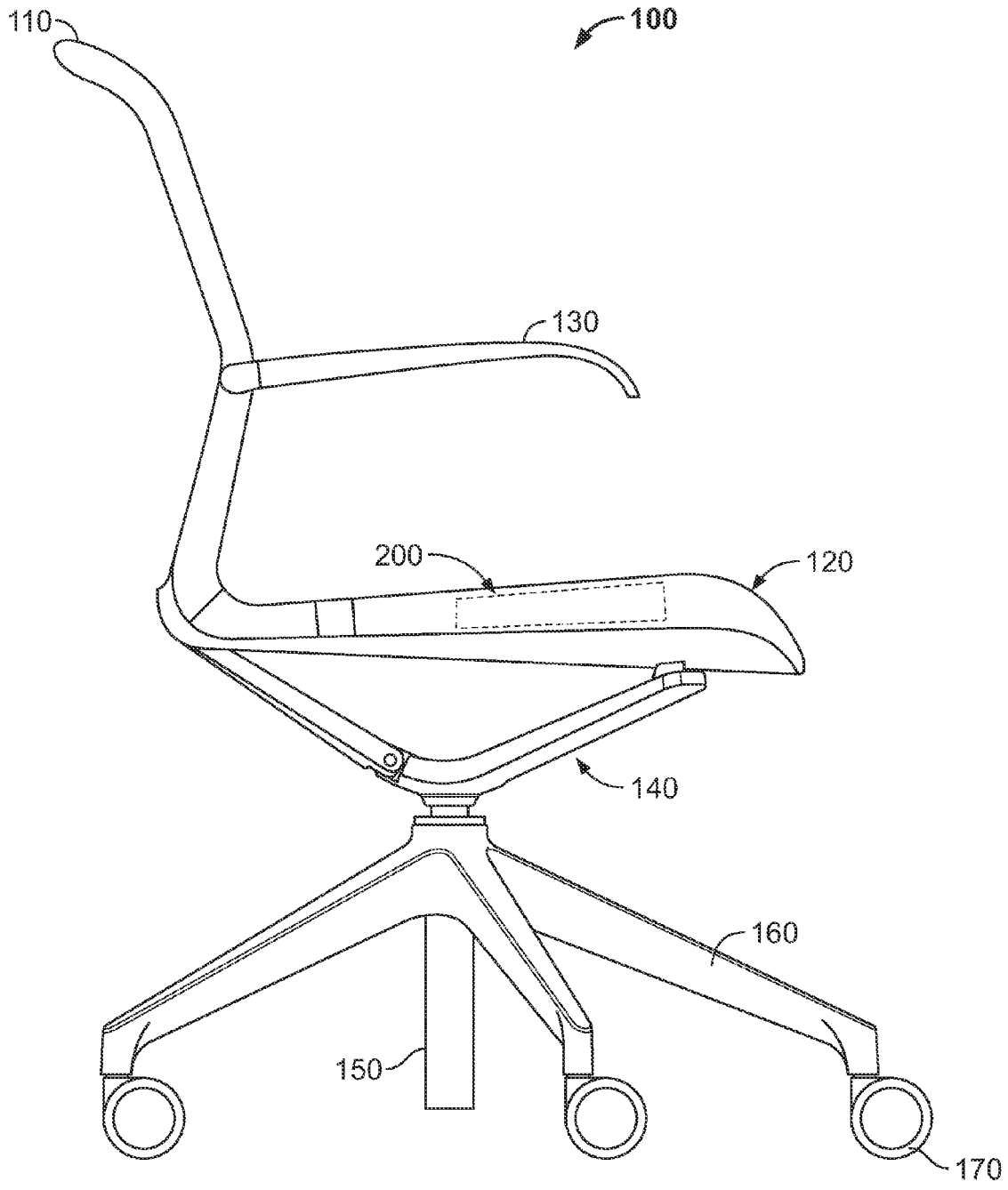
FIG. 2 is a side view of the chair of FIG. 1 showing approximate location of an invisible syncro mechanism.

As shown in FIGS. 1 and 2, a chair is provided. The chair 100 has a seat back 110, seat pan 120 and arm rests 130, as are familiar in many models of chairs. As is best seen in FIG. 2, the chair has a structure supporting the seat back and seat pan.

Figure 4A:
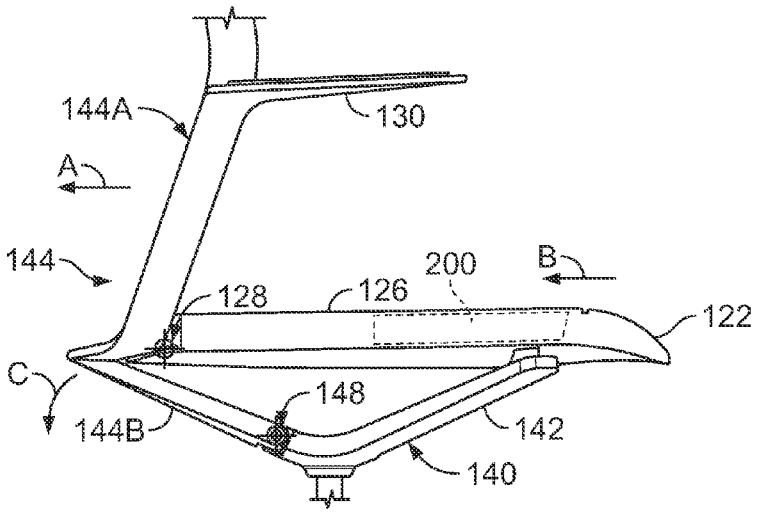
FIGS. 4A-4C illustrate a progression of tilting applied to a chair according to an embodiment of the present invention.
Figure 4B:
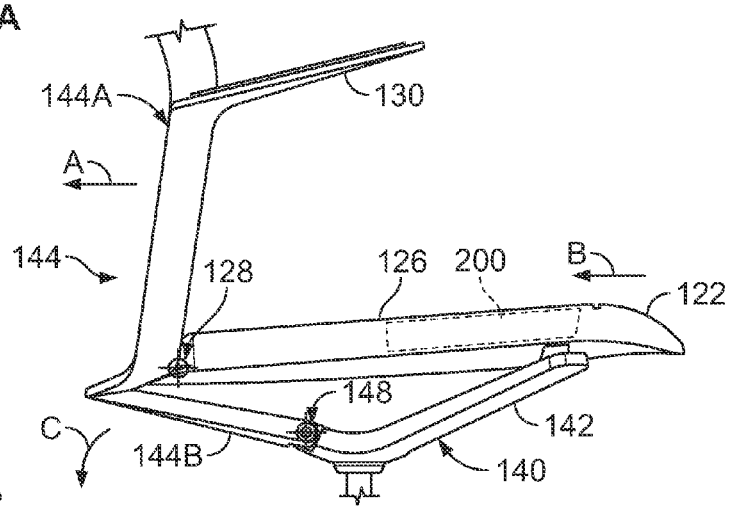
Figure 4C:
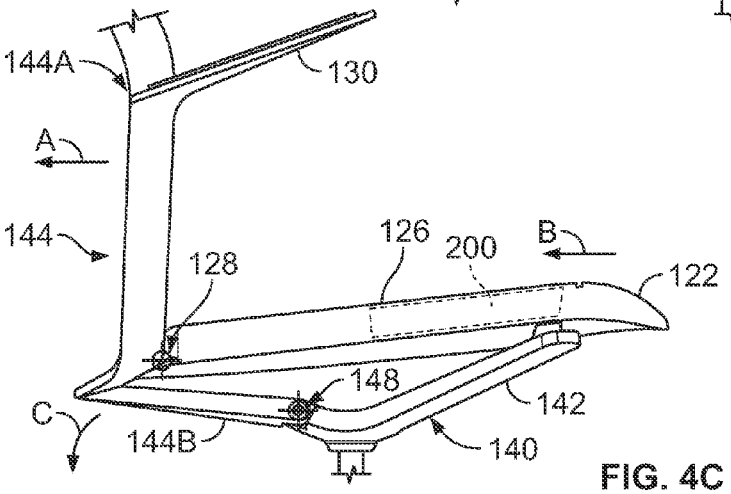

In this case, a wishbone/J-bar assembly 140 is provided. The J-bar 144 is an assembled or one-piece armature that frames the back and extends partway under the seat pan. It has a portion 144A that supports the seat back 110 and a portion 144B that supports the seat pan 120. It can also have arms 130 incorporated into or attached to it. The components of the assembly 140 can be made up of cast or molded materials, or fabricated (e.g. welded) parts. The J-bar 144 connects to a wishbone segment 142 that meets the seat pan closer to the front. The J-bar 144 pivots against the wishbone 142 at 148 as in FIGS. 4A-4C. The wishbone 142 is connected to the base 160 through pedestal 150. The seat may be raised and lowered by extending the pedestal up or down through the base as is well-known. A five-point "star"

base is shown as one typical embodiment. However, it will be appreciated that various types of bases may be provided in various configurations (and may include or omit, for example, wheels or rollers 170).

The seat pan 120 is suspended over the J-bar 144 and wishbone 142 assembly 140 and is secured generally in pivot area 128 using mounting pins that allow for multiple synchronized pivots, and in the front through assembly 200. The seat pan is shown here without covering or padding, but would be an upholstered or otherwise covered piece in typical configurations. Preferably, the front edge of the seat pan 122 has a smooth waterfall-like shape and may itself flex to provide comfort against the bottom of the user's thighs over the range of tilt.

Hidden inside the seat pan 120 is an "invisible" mechanism 200. Briefly stated, with pivots 148, 128, this mechanism 200 provides a simple, non-bulky means of allowing the user to tilt both the back rest 110 and seat pan 120 together at related but not equal rates of tilt. The mechanism preferably does not require adjustment or customization. The user can simply sit down and move naturally into and out of tilted poses, using the chair for desk-oriented tasks or in more relaxed postures. The chair supports these movements and gently draws back to neutral without the user feeling any sense of jerkiness or loss of control, and without feeling that the user's knees are being lifted up, or that the user's backside is slipping down.

Figure 3:
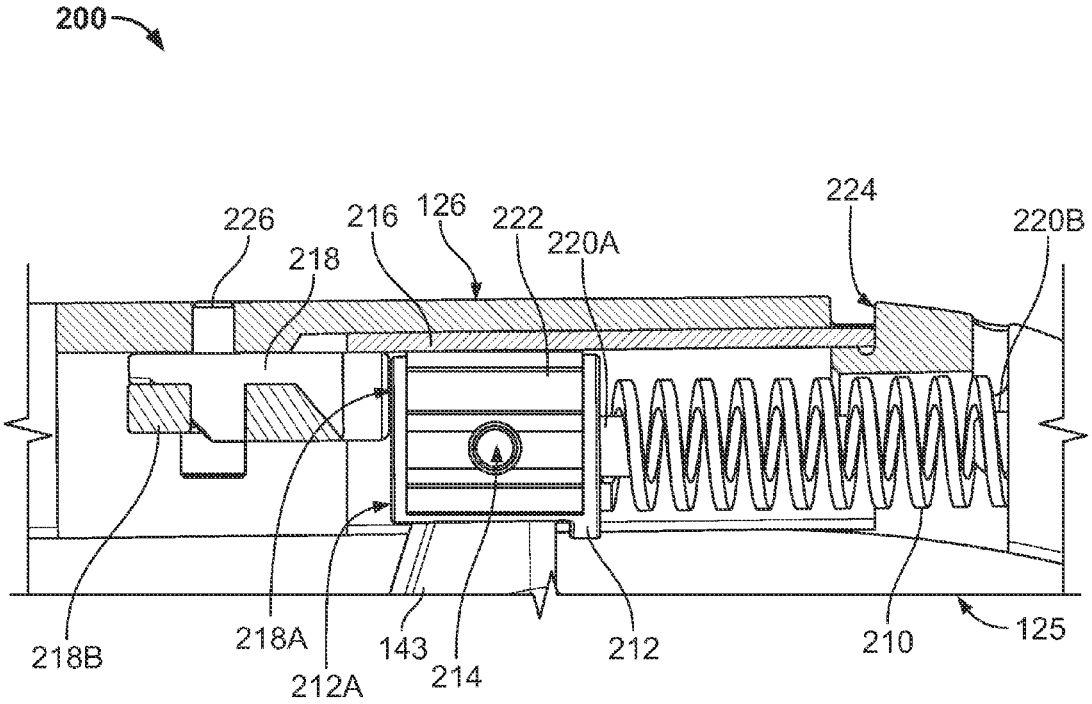
FIG. 3 is a detailed sectional view of an invisible syncro mechanism according to an embodiment of the present invention.

Turning to the mechanism itself as shown in FIG. 3, the invisible mechanism 200 has relatively few parts. The two main components are a spring 210 and a plunger 212. Both are confined within a hollow track 216 in the structural seat pan 120. No parts extend or protrude outside or below the seat pan's top 126 and bottom 125 surfaces. In this sense, it is virtually invisible. The plunger is attached to the front portion of the wishbone 142 at seat pan mount 143 via mounting pin 214. The mounting pin 214 allows the plunger to rotate on its axis as its path of travel in the track 216 will change slightly as the seat pan is tilted. The plunger preferably has a smooth and slippery sleeve bearing 222 around it. Preferably, the plunger bearing 222 is a snap housing of a low friction material (e.g. an acetal resin such as polyoxymethylene). The plunger 212 (with its bearing 222) glides in a plunger track 216 (preferably of extruded aluminum which may, for example, be Teflon-anodized for low friction). The track 216 may snap into its own recess in the seat pan locking in, for example, to an undercut 224 as shown and is then finally secured and located by mounting stop 218. The plunger also allows for torsional deflection across the seat pan.

The front of the plunger 212 has a spring locator 220A. The front surface of the interior of the seat pan 120 has a corresponding spring locator 220B. The spring 210 (preferably a coil spring as shown here) is mounted between the locators 220A, 220B. The plunger has four functions: allowing synchronous sliding of the seat, allowing torsional movement of the seat, pre-loading the spring tension, and cooperating in the compression of the spring during use.

The spring 210 is preferably pre-tensioned by mounting stop 218 via mounting wedge 218B using bolt 226. The wedge 218B allows the mounting stop 218 to provide a backstop for the plunger 212 less than the full maximum extension of the spring 210, eliminating the possibility that the plunger does not travel back to the maximum extent of the channel and so that it is always fully engaged in the track for smooth operation. It also secures plunger track 216 into position in seat pan 120.

Figure 5A:
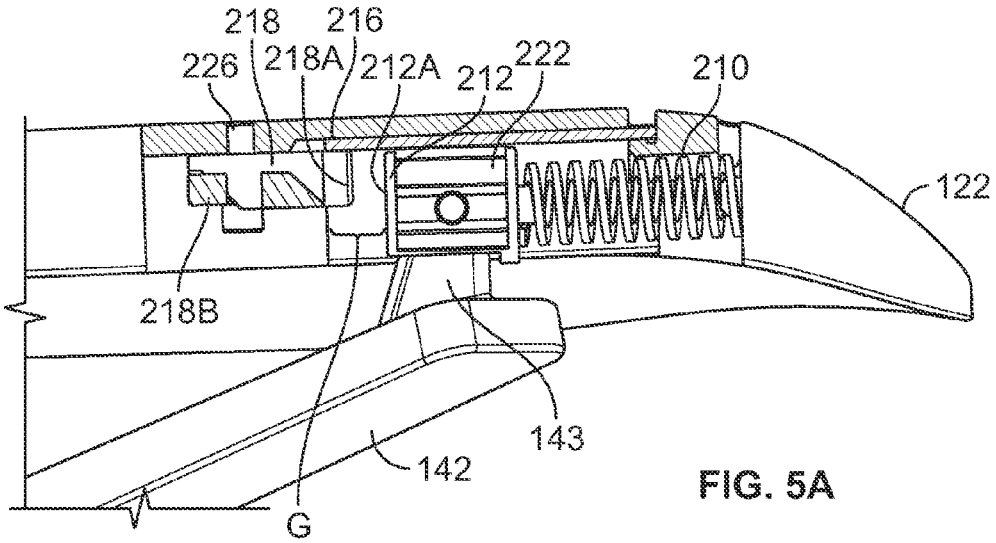
FIGS. 5A-5C illustrate a parallel progression with FIGS. 4A-4C showing a sectional view of the invisible syncro mechanism as tilting forces are applied to the chair.
Figure 5B:
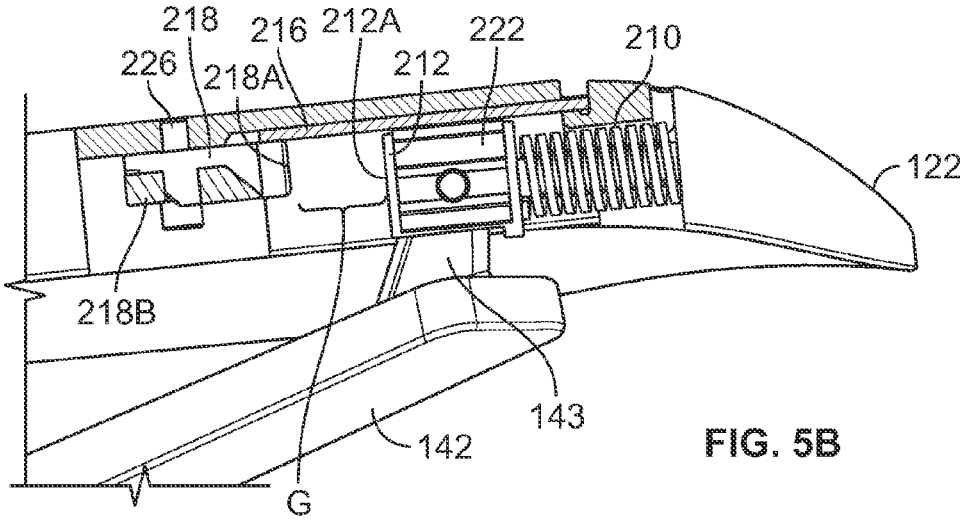
Figure 5C:
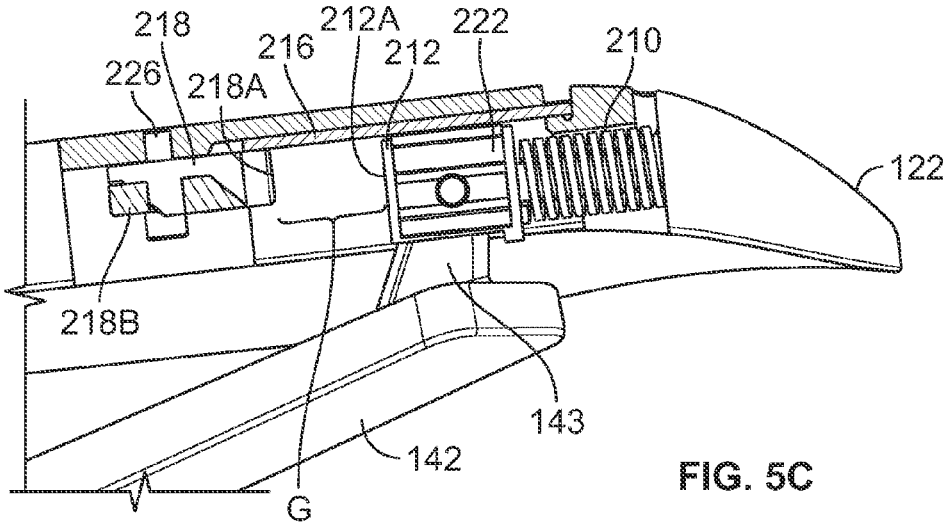

In operation, the mechanism allows the back and seat pan on the J-bar to pivot downwardly in an arc from pivot 148 in direction C. As the user leans back A, the seat pan 120, being pulled backwards by the J-bar 144, follows direction B while simultaneously moving downward at its rearward pivot 128 in direction C with the J-bar. That is, the J-bar 144 goes back and down in a large arc. The seat pan 120 moving in direction B begins to compress spring 210 as the plunger 212 attached to the wishbone 142 at mount 143 opposes from the other side. The plunger 212 is stationary while the seat pan moves. The plunger's relative position against movement of the seat pan can be observed by comparing the gap G between surface 218A of the mounting stop 218 and surface 212A of plunger 212 across FIGS. 5A-5C. The gap G (i.e. distance between the plunger 212 and the backstop provided by the stop 218) gets bigger as the plunger and front of the seat pan cooperate to compress spring 210. When the spring 210 has compressed in reaction to its load as at FIG. 5C, the chair back and seat are prevented from tilting further. The spring gently returns the seat and back to neutral when tilting force is removed. Neutral orientation of the mechanism is shown in FIG. 3.

You will note that the seat pan and back may tilt to different degrees. To illustrate, the spring may move a distance of less than once inch. The pitch of the seat pan may have a range of approximately 0.5°-5.5°, while the back may have a range of approximately 18°-35°. It will be appreciated that these ranges and distances are merely illustrative of one possible embodiment. It is not intended to limit the invention accordingly.

The scope of the claims should not be limited by the preferred embodiments set forth in the foregoing disclosure, but should be given the broadest purposive construction consistent with the description as a whole and having regard to equivalents set forth or implied.

The invention claimed is:

1. In a chair having a seat having a back portion and a seat pan portion, the seat pan portion being connected to the back portion and to a pivotable support structure, and thereby to a base, a mechanism in the seat pan portion, the mechanism comprising:

a generally closed track defined in the seat pan portion, a front end of the track having a first attachment point;

a plunger attached to a front portion of the pivotable support structure, the plunger disposed in the track and slideable therein, the plunger being pivotally mounted for pivotal rotation when torsional deflection of the seat pan portion occurs, a front end of the plunger having a second attachment point; and a spring disposed in the track connected at opposing ends to the first attachment point and to the second attachment point, wherein as the back portion is tilted backward such that the back of the seat pan portion is pulled backward and downward with the back portion against the pivotable support structure, the spring of the mechanism is compressed between the first attachment point and the second attachment point; and when tilting force is removed, the spring returns the seat pan portion and thereby the back portion into neutral orientation, wherein the mechanism does not extend or protrude outside of the seat pan.

2. The mechanism of claim 1, wherein the track is coated for anti-friction.

3. The mechanism of claim 1, wherein the track comprises an anti-friction sleeve.

4. The mechanism of claim 1, wherein the plunger has an anti-friction sleeve bearing.

5. The mechanism of claim 1, further comprising a barrier or wedge disposed in the track behind the plunger, the barrier or wedge acting as a backstop and pre-tensioner.

6. The mechanism of claim 1, wherein the spring is a coil spring.

7. The mechanism of claim 1, wherein the plunger is pivotally mounted with a mounting pin.

8. The mechanism of claim 1, wherein the plunger is shaped to allow compression of the spring, which is a compression spring disposed horizontally.

* * * * *